US005778577A

United States Patent [19]

Bailey

[11] Patent Number: 5,778,577

[45] Date of Patent: Jul. 14, 1998

[54] CHANGEABLE NUMERIC SIGNS

[76] Inventor: James David Bailey, 546 Chilhowee School Rd., Seymour, Tenn. 37865

[21] Appl. No.: 663,788

[22] Filed: Jun. 14, 1996

[51] Int. Cl.[6] ..... G09F 3/04

[52] U.S. Cl. ..... 40/450; 40/492

[58] Field of Search ..... 40/450, 447, 449, 40/453, 492; 340/815.86, 815.56, 472, 473, 484, 485, 907, 908, 927, 930, 764

[56] References Cited

U.S. PATENT DOCUMENTS

| | | | |
|---|---|---|---|
| 567,379 | 9/1896 | Dalumi | 40/447 |
| 1,923,523 | 8/1933 | Whitney | 40/447 |
| 3,250,031 | 5/1966 | Bowman | 40/447 |
| 4,164,824 | 8/1979 | Nidelkoff | 40/450 |
| 4,496,945 | 1/1985 | Stadjuhar et al. | 40/450 X |
| 4,542,603 | 9/1985 | Streeter et al. | 40/447 |
| 5,022,171 | 6/1991 | Norfolk et al. | 40/452 X |
| 5,526,599 | 6/1996 | Roussel | 40/450 |
| 5,566,482 | 10/1996 | Smith | 40/450 |

FOREIGN PATENT DOCUMENTS 1460598 7/1965 France .

*Primary Examiner*—C. D. Crowder
*Assistant Examiner*—Tina R. Taylor
*Attorney, Agent, or Firm*—Dowell & Dowell, P.C.

[57] ABSTRACT

A changeable sign comprises an enclosed outer housing and inner changeable number display areas. The number display areas are comprised of vertically spaced sections, each including a plurality of rotatable horizontal flaps. The flaps are rotated by motors which may be controlled on-site or remotely using telephone, pager or radio remote controllers. Different arrangements of number displays may be provided to display the time, temperature, single digit numbers, multiple digit numbers and decimals as well as other characters. The sign has a compact construction and is weather resistant.

23 Claims, 8 Drawing Sheets

CHANGEABLE NUMERIC SIGNS

BACKGROUND OF THE INVENTION

1. Field of the Invention

The invention relates generally to the field of signs and, more particularly, to signs having changeable displays which are compactly mounted within enclosed housings and which may be remotely controlled.

2. History of the Related Art

Numeric and alphanumeric signs having changeable characters and intended for outdoor uses are well known. Such signs are commonly used in applications such as theater marquees, stadiums, convention centers, gasoline station price boards and billboards. The signs include types having manually changeable characters and other types including electro-mechanical systems for automatically changing the characters.

Signs having manually changeable characters have a number of disadvantages. First, the characters are typically uncovered and exposed to damage from wind, water and debris. Metallic sign components are prone to corrosion and the characters may also be displaced due to high winds and severe weather and are easily vandalized. Secondly, the manual changing of characters is time consuming. Thirdly, because the signs are normally elevated, persons changing the characters by hand are subjected to dangerous working conditions and potential injury from falling.

Signs having automatically changeable characters also have disadvantages. Automatic signs are known that include electro-mechanical mechanisms for changing the character displays. Such mechanisms are complex and increase the size of the signs. Furthermore, automatic signs for outdoor use fail to protect the components from the weather, dirt and debris and, accordingly, the components are prone to corrosion and/or failure. Further, many automatic signs include large rotatable flaps that necessitate a deep outer housing be used to contain the flaps. Such deep housings cause shadowing when a sign is illuminated by lighting assemblies or vehicle headlights. Furthermore, such deep housings prevent the entire display from being seen from all forward angles.

Thus, there is a need for signs that overcome the above-described disadvantages of conventional signs.

SUMMARY OF THE INVENTION

The present invention has been made in view of the above-described deficiencies and disadvantages and has as an object to provide a sign suitable for outdoor use having a compact and fully enclosed construction to thereby protect display components while overcoming problems associated with large conventional housings.

It is a primary object of the present invention to provide signs, and especially numeric signs for outdoor use, which are completely enclosed to provide weather resistance, prevent premature component failure due to component contamination, and to prevent damage by vandalism.

Yet another object of the present invention is to provide signs having characters which are manually changeable on-site, or remotely changeable using selected remote control devices.

Additional objects and advantages of the present invention will become apparent from the detailed description which follows and the accompanying drawings. To achieve the objects of the invention, the signs in accordance with a preferred embodiment of the invention comprise an outer housing including back, frame border and cover. A plurality of horizontally spaced columns of changeable display assemblies or sections are mounted within the housing for displaying numbers, characters or symbols. The changeable assemblies include a plurality of parallel horizontal relative narrow flaps, each having first and second generally oppositely oriented faces which may be coated using first and second contrasting colors. Each of the flaps in a respective changeable display are connected to shiftable brackets and a drive means is connected to one of the flaps in the each assembly for rotating the flaps to display one of the faces to form a number, character or symbol. As the driver flap is rotated, the interconnecting bracket will also pivot or rotate the remaining flaps of the same changeable assembly.

The number of columns of changeable display assemblies may be varied for displaying selected numbers such as the cost of a commodity per unit, a total of a score or event, temperature or time of day. Some of the columns include a plurality of movable or changeable display assemblies as well as one or more non-movable sections which may be colored to match the color of one of the faces of the flaps of the changeable display assemblies.

In accordance with the invention, the outer housing encloses the display assemblies to prevent water and debris from entering the sign. In addition, the flaps are of relatively narrow configuration and generally of a width substantially equal to the dimension between the cover and back of the sign so that the faces thereof are assured of being in close proximity to the cover when displayed.

The changeable display assemblies of the signs may be controlled manually on-site, or remotely using telephone, pager and radio remote controllers. Also, the signs are energy efficient and may be powered by conventional rechargeable batteries or other suitable power sources.

As previously stated, the signs in accordance with the invention are capable of displaying numbers, characters and symbols to indicate the time, positive and negative temperatures, single whole numbers, multiple digit whole numbers and decimals and other varied information.

DETAILED DESCRIPTION OF THE PREFERRED EMBODIMENT

Figures 1, 2:
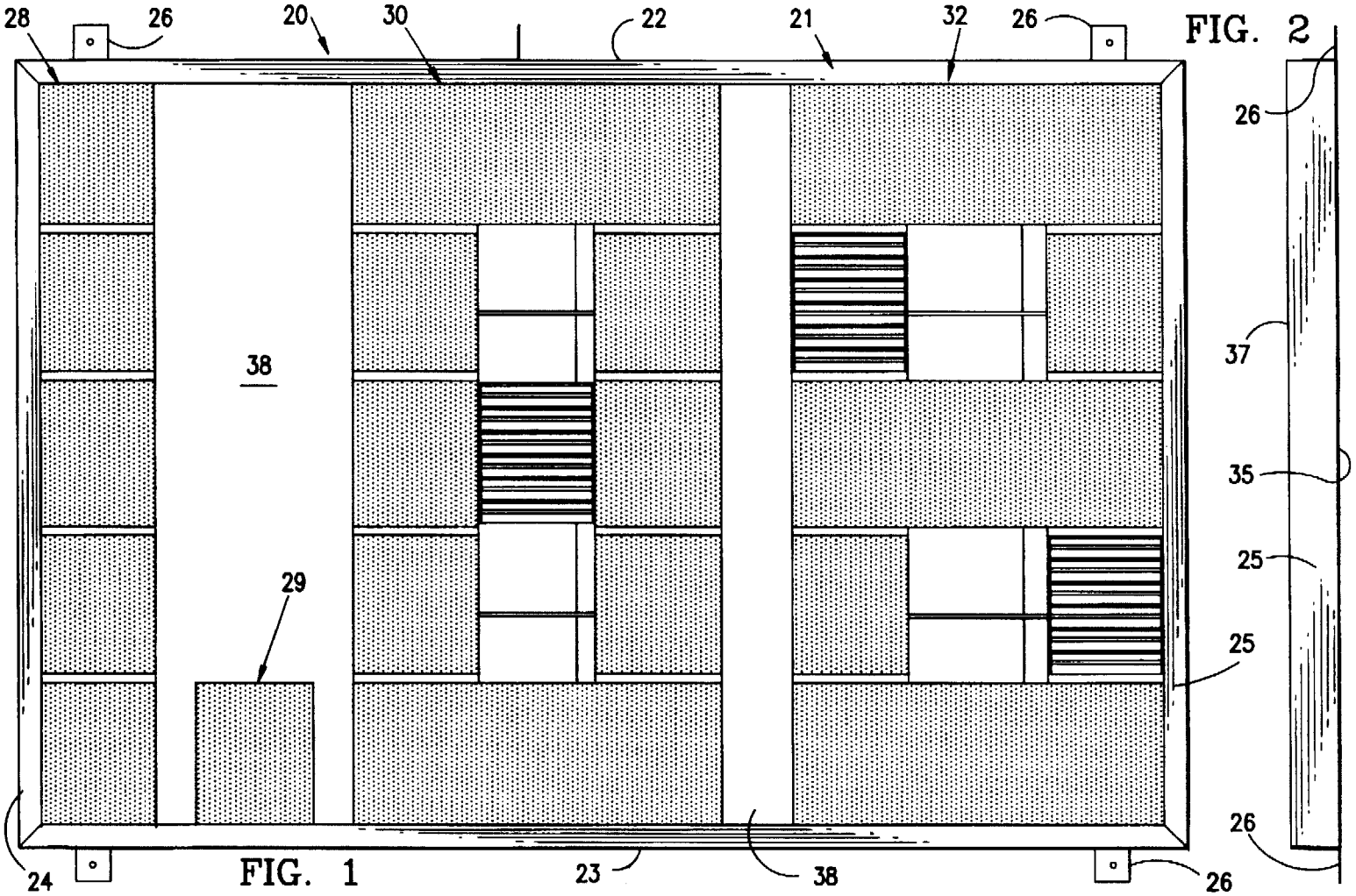
FIG. 1 is a front elevational illustrational view of a changeable sign in accordance with an embodiment of the invention displaying the number "1.02"
FIG. 2 is a left side view of the sign of FIG. 1.

The preferred embodiment of the invention will now be described in detail with reference to the drawing figures.

FIG. 1 illustrates a numerical sign 20 in accordance with a preferred embodiment of the invention. The number "1.02" is displayed, and the sign is capable of displaying selected two and three-digit numbers ranging from "0.00" to "1.99".

The sign 20 comprises an outer frame 21 including an upper frame member 22, a lower frame member 23, and side frame members 24 and 25. A plurality of mounting brackets 26 are attached to the outer frame 21 for mounting the sign to gasoline station price boards, billboards and like support structures. The sign comprises a first changeable character or number display area 28, a horizontally-spaced dark colored region 29 representing a decimal point ".", a second number display area 30 and a third number display area 32. The first display area 28 is only capable of displaying the number "1", as shown, or of displaying no number such that the sign displays a two-digit number (not shown) between ".00" and ".99". The second display area 30 and the third display area 32 can display all numbers between "0" and "9".

Figures 5A, 5B:
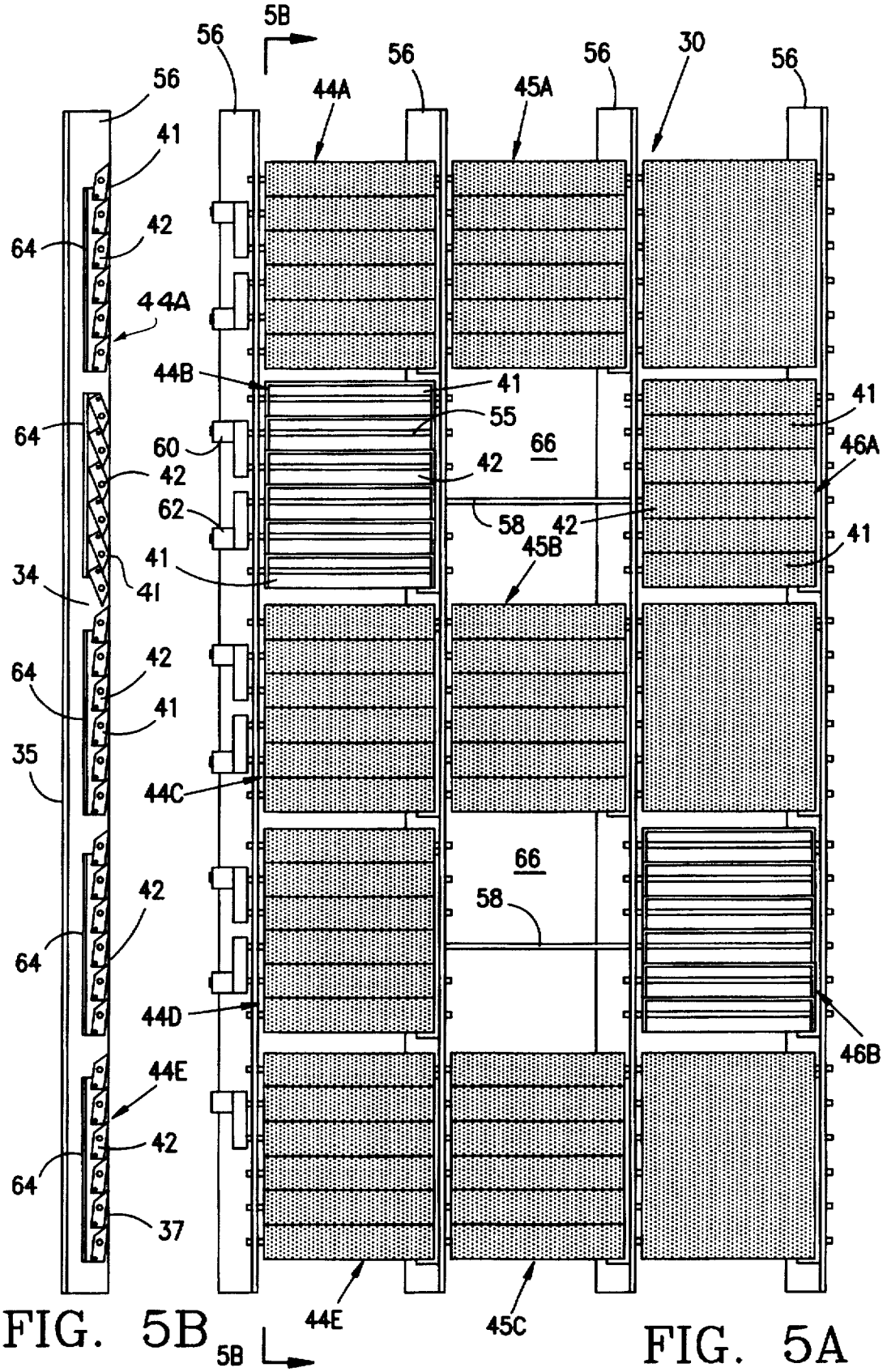
FIG. 5A is an illustrational view of a portion of the sign of FIG. 3 with the flaps of the changeable display assemblies in an initial position displaying the number "2"
FIG. 5B is a view taken in the direction of line 5B—5B of FIG. 5A.

The sign 20 is preferably completely enclosed to prevent water, dust and other debris from entering the interior space 34, see FIG. 5B, and corroding or causing movement failure of the components of the sign. The sign comprises a back wall 35, see FIG. 2, having a light colored front face 36, see FIG. 3, and a front cover 37 composed of glass or a like transparent material secured to the outer frame 21. Motor covers 38 are shown in place behind the front cover and between the display areas. The fixed dark colored region 36 may be a separate cover or a dark colored region of one of the motor covers.

Figure 3:
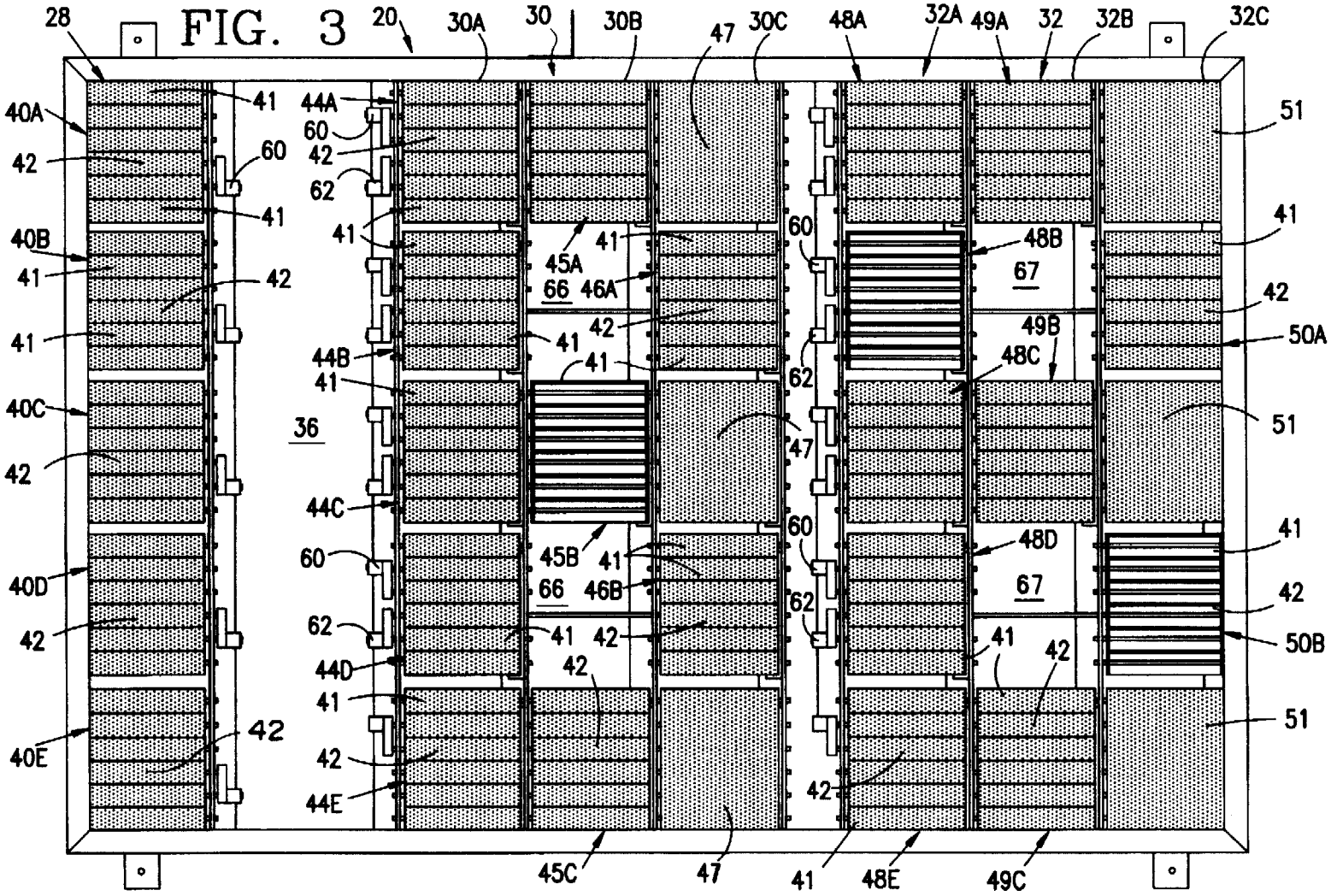
FIG. 3 illustrates the sign of FIG. 1 with the cover or covers removed to show internal components.

Referring to FIG. 3, the first display area 28 includes a single column of vertically spaced changeable character display assemblies or sections 40A–40E. These sections each include a plurality of parallel, horizontal rotatable flaps 41, 42. In the illustrated sign, there are five sections, and each section includes five flaps 41 and one control or driven flap 42. The front and rear faces of each of the flaps are contrastly colored. For example, one face may be colored black or another dark color, and the opposite face may be colored white or another light color to provide a high degree of color contrast. One color preferably corresponds to the light color of the motor covers 38, and the other color preferably corresponds to the dark color of the region 29. Each of the flaps are shown displaying their dark colored face to form the number "1".

The provision of a plurality of small flaps which are rotatable about horizontal axes, as opposed to a single large flap of equivalent display area, allows the flaps to rotate within a minimal amount of space, and significantly reduces the depth of the outer frame 21 between the cover 37 and rear or back wall 35. By reducing this depth, problems associated with shadowing are reduced. The reduced depth provides the further advantage of making the numerical display visible to viewers positioned beneath the sign at closer distances as compared to signs having relatively deeper housings as the numbers will be closely spaced to the front cover.

The dimensions of the flaps, the number of flaps per section, and the number of sections in the display area 28 may be varied depending on the desired size of the displayed numbers. For example, a five foot high number preferably includes six flaps per section as shown, with the flap height being about two inches. A seven foot high number preferably includes sections having eight flaps of this same height. It should also be noted that the depth of the sign between the cover and the rear wall need only be slightly greater in dimension than the height of the flaps so that the housing is compact but sufficiently deep to allow rotation of the flaps therein.

The flaps are preferably formed of aluminum. This light-weight metal reduces the weight of the sign and provides corrosion resistance.

The second display area 30 is comprised of three vertical columns 30A, 30B, 30C. The first column includes five vertically spaced changeable characters display assemblies or sections 44A–E, each having a plurality of rotatable flaps 41, 42 as previously described. The second column includes three changeable character display assemblies or sections 45A–C having rotatable flaps 41, 42. Between these three sections, the front face 36 of the back wall is visible, and provides color contrast with the dark faces of the flaps. The third column includes two changeable character display assemblies or sections 46A–B having movable flaps 41, 42 and three alternating, fixed, dark colored display sections 47. As shown, for example, in FIG. 5A, the fixed sections are mounted to vertical mounting brackets 56.

The third display area 32 also comprises three columns 32A–C and preferably has the same construction as the second display area 30. The first column includes five changeable character display assemblies or sections 48A–E, each having a plurality of movable flaps 41, 42. The second column comprises three changeable character display assemblies or sections 49A–C having movable flaps 41, 42, and the front face 36 of the back wall is visible between the three sections. The third column comprises two changeable character display assemblies or sections 50A, 50B having movable flaps 41, 42, and three fixed, dark colored display sections 51.

Figure 4:
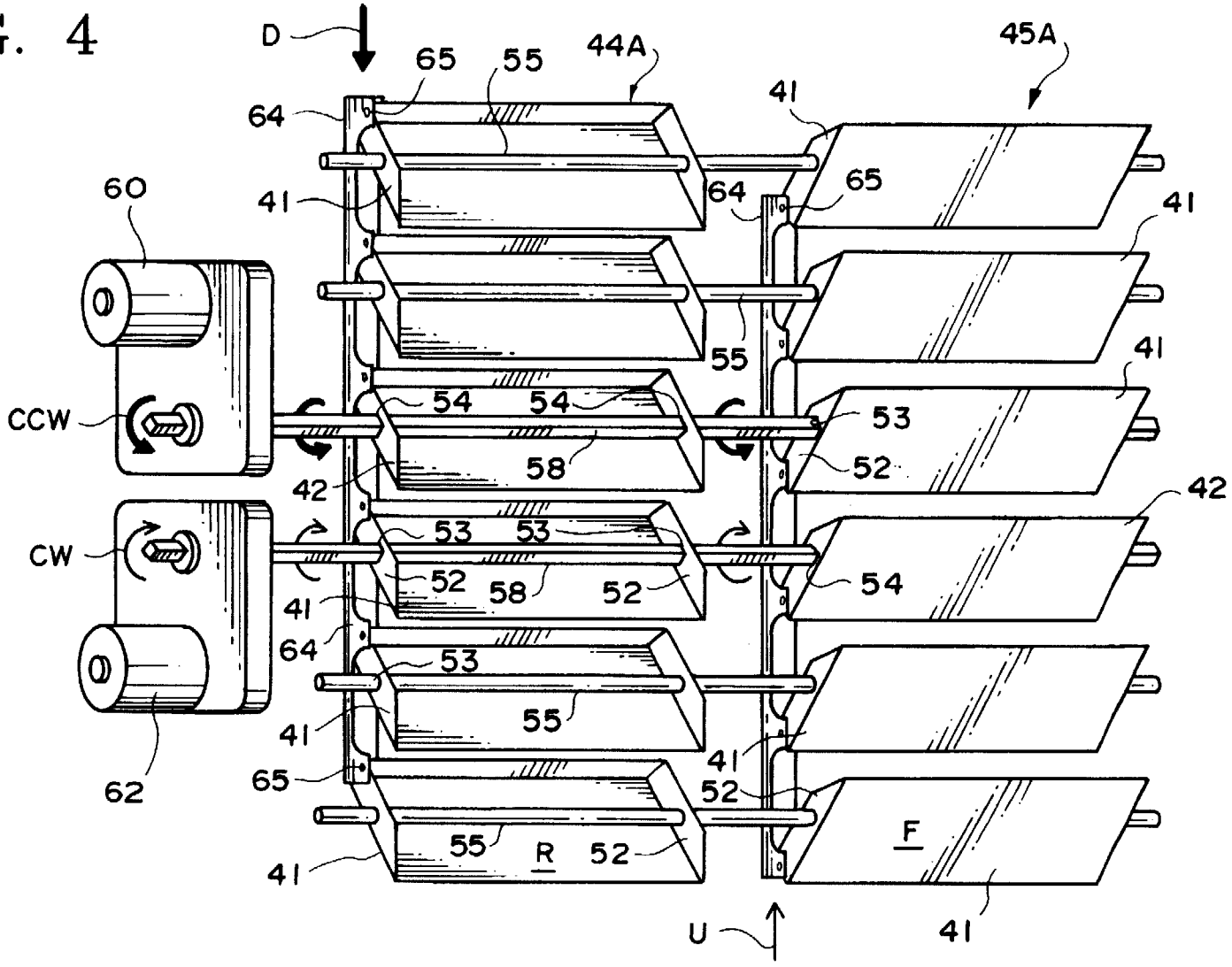
FIG. 4 is an illustrational view showing the movement of a pair of adjacent changeable character display assemblies illustrating the movements of the flaps associated therewith.

With particular reference to FIG. 4, each of the flaps 41, 42 include sides 52 which have aligned openings 53 and 54, respectively, therethrough. Most of the flaps 41 are pivotally mounted about support rods 55 which extend through the openings 53. A single support rod may extend through a plurality of horizontally spaced flaps 41 of the same display area 30, 32. The rods 55 are mounted to the support brackets 56 which are secured to the rear wall of the housing, as generally shown in FIG. 5A. As opposed to rods, separate pivot pins may be used to connect the flaps 41 to the support brackets 56.

The driven flaps 42 and some of the flaps 41 spaced horizontally in alignment with the flaps 42 are mounted to driven support rods 58 which are driven by motors 60 and 62. To facilitate the ease of construction and assembly, rods 58 have a rectangular or other non-circular cross-section which is complimentary to the configuration of the openings 54 in the sides of the flaps 42. In this manner, the flaps 42 are keyed to and will rotate with the rods 58. In those instances when a flap 41 is supported by a driven rod 58, the openings 53 in the side walls are made circular to allow the rods to freely rotate therein so that no motion is imparted to the flaps 41. This feature is shown in flaps 41 of FIG. 4.

FIG. 3 illustrates the sign 20 of FIG. 1 with the motor covers 38 removed to show the motors 60, 62 for changing the display flaps 41, 42 mounted to the mounting members or brackets 56. The motors are preferably 12 volt DC motors. Other suitable motors may be used. As shown, in the first display assembly 28, a motor 60 is provided for each of the sections 40A–E.

In the second display area 30, a pair of motors 60, 62 are provided for each of the groups of sections, (44A, 45A), (44B,46A), (44C, 45B) and (44D, 46B), and a single motor 60 is provided for the lower sections 44E, 45C. A pair of motors may optionally be provided for the lower sections (not shown).

In the third display area 32, a pair of motors 60, 62 are associated with the groups of sections, (48A, 49A), (48B, 50A), (48C, 49B) and (48D, 50B), and a single motor 60 is provided for the lower sections 48E, 49C. A pair of motors may optionally be provided for the lower sections (not shown).

FIG. 4 illustrates the operation of the sections 44A and 45A of the second display assembly 30. The operation of these two sections is identical to the operation of the pairs of sections 44C, 45B of the second display area 32, and to the pairs of sections 48A, 49A and 48C, 49B of the third display area 32. As shown, the upper motor 60 rotatably drives a driven rod 58' in the counter-clockwise direction as represented by the arrow CCW. The rod 58' fits tightly within the openings 54 formed in the driven flap 42. Each driven flap 42 and the flaps 41 of each changeable section of the sign are pivotally connected to separate pivot control linkage brackets 64 by pivot pins 65. As shown, the area of the front face F of each of the flaps 41, 42 may be greater than the area of the rear face R. In FIG. 4, as rod 58' rotates flap 42 counter-clockwise, the bracket 64 shifts downwardly as represented by the arrow D, thereby rotating the flaps 41.

As previously mentioned, control rod 58' also extends through an opening 53 in the flap 41 of the adjacent section. The opening 53 is oversized relative to the rod, however, so that the flap 41 is not driven by the rod. Accordingly, the upper motor 60 controls only the operation of display section 44A.

The operation of the flaps of the display section 45A are controlled by the lower motor 62, which rotatably drives a lower driven rod 58 in the clockwise direction as represented by the arrow CW. The lower rod 58 extends through an opening 53 in the flap 41 in section 44A and through a fitted opening 54 in the driven flap 42 in section 45A. The opening 53 is oversized relative to the lower rod 58 so that the flap 42 of section 44A is not rotatably driven. The lower rod 58 extends through an opening 54 formed in the driven flap 42 of the display section 45A. The flap 42 and the other flaps 41 of section 45A are each pivotally connected to the adjacent bracket 64 by pivot pins 65. As the lower rod rotates, the flap 42 is rotated in the clockwise direction, moving the bracket 64 upwardly as represented by the arrow U, thereby rotating the flaps 41 also in the clockwise direction. Accordingly, the lower motor 62 controls only the operation of the section 45A.

The pair of sections (44B, 46A) and (44D, 46B) of the second display area 30 are separated by the light-colored regions 66 wherein no moveable flaps are located and the pair of sections (48B, 50A) and (48D, 50B) of the third display area 32 are separated by the light-colored regions 67 wherein no moveable flaps are located. For the second display area 30, the flaps of section 44B are controlled by a motor 60, the flaps of section 46A are controlled by a motor 62, the flaps of section 44D are controlled by a motor 60, and the flaps of section 46B are controlled by the motor 62.

For the display sections 44E and 45C, a motor 60 is associated with a driven rod 58 which is connected to driven flaps 42 of each section and the motor simultaneously drives the remaining flaps 41 of each section through movement of the associated brackets 64.

For the third display area 32, the operation of the sections are preferably identical to the operation of the sections of the second display area 30.

In the first display area 28, the motors 60 are each fixedly connected to a control flap 42 by a control rod 58, as previously described and each of the flaps 41, 42 of each section are pivotally connected by pins 65 to shifting brackets 64.

Figure 5C:
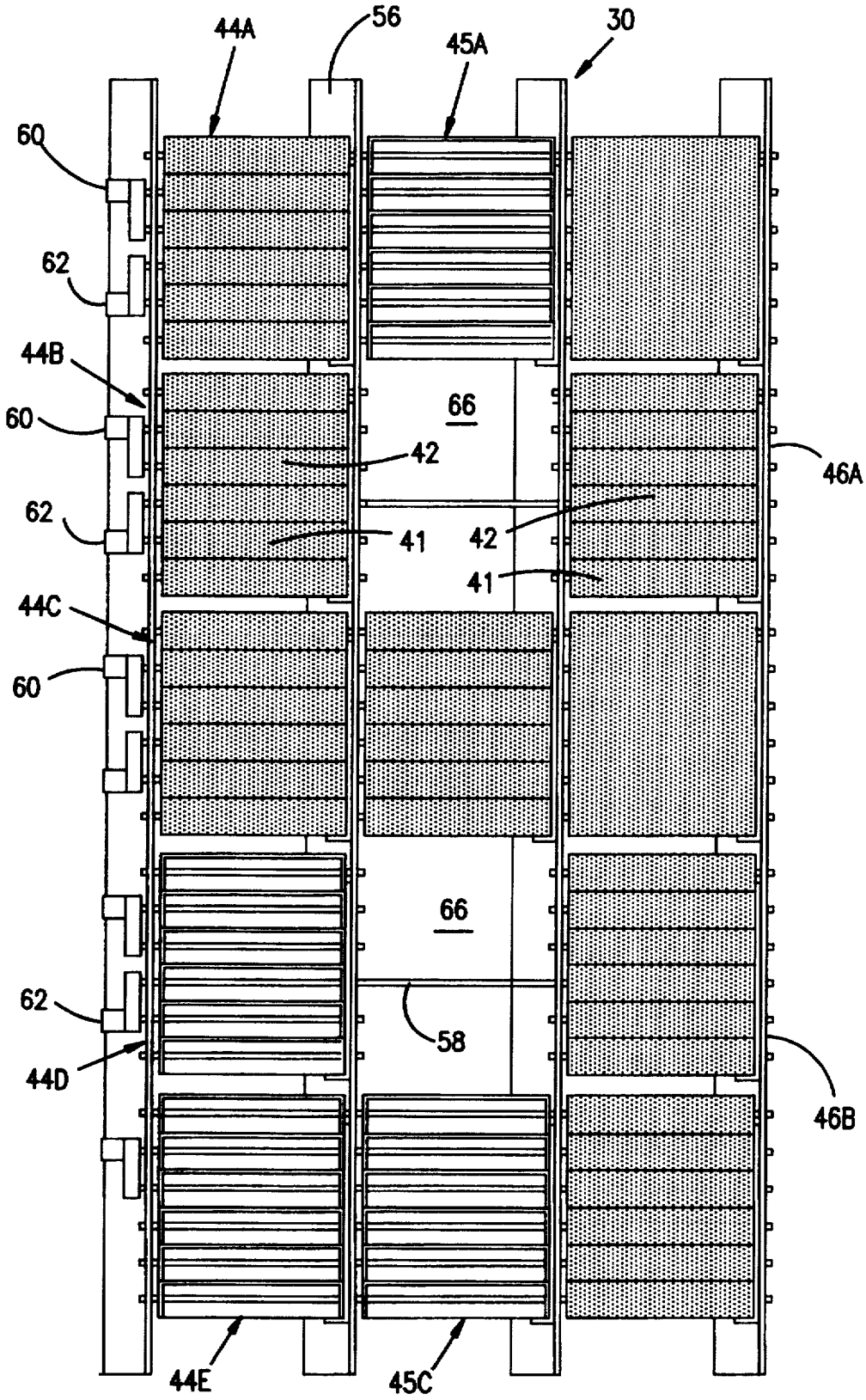
FIG. 5C illustrates the portion of the sign of FIG. 5A changed to display the number "4"

FIGS. 5A–5C illustrate the progressive operation of the second display area 30 as the displayed character is changed from "2" to "4". The operation of the illustrated third display area is the same as that of the second display area. FIG. 5B is a side view illustrating the position of the flaps 41, 42 before the number changing.

Referring to FIG. 5A, initially, the light faces of the flaps of the sections 44B and 46B face forwardly, and the dark faces of the flaps of the remaining sections face forwardly. To change the displayed number from "2" to "4", the flaps of the sections 44B and 46B are rotated counter-clockwise to display their dark faces, and the flaps of the sections 44D, 44E, 45A, 45C are rotated clockwise to display their light faces, as shown in FIG. 5C.

Figure 6:
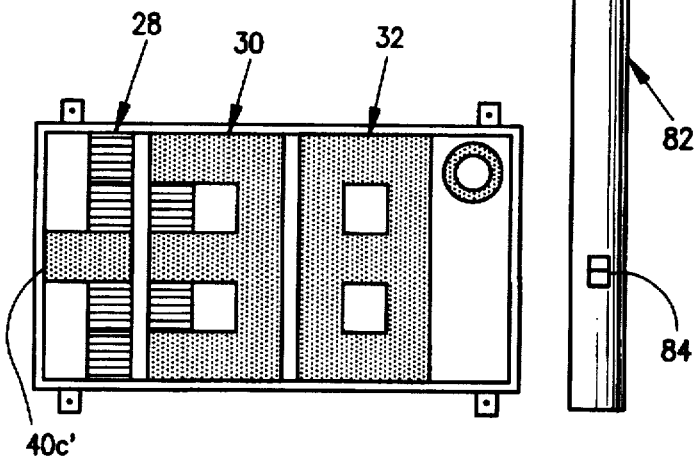
FIG. 6 illustrates a sign in accordance with the invention displaying the temperature.

In accordance with the invention, the sign may include as few as a single display area to display a single digit number, or a plurality of display areas to form numbers with plural digits. For example, referring to FIG. 6, the illustrated sign in accordance with the invention displays the temperature. The sign comprises first display sections similar to sections 40A–40E of the embodiment of FIG. 3. A single section 40C' having rotatable flaps having dark faces as shown and opposite light colored faces (not shown) is provided adjacent section 40C. Second and third display areas similar to 30 and 32 follow the first display area. The second and third display assemblies are each capable of forming the numbers "0" to "9". A degree symbol "°" is provided on the sign following the third display area.

Figure 7:
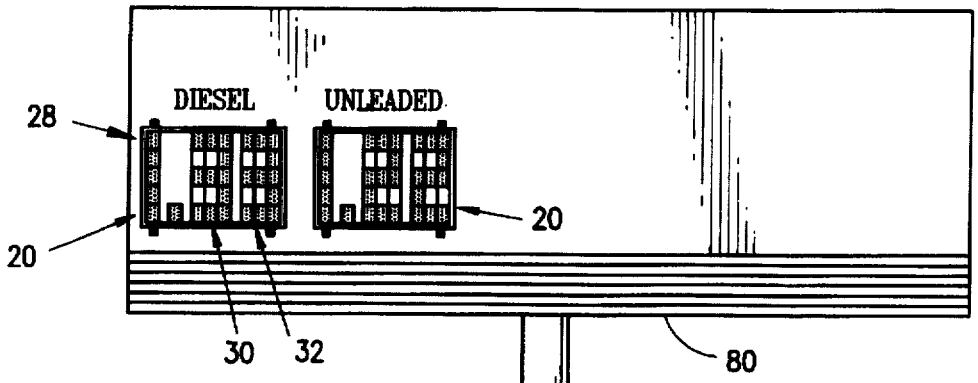
FIG. 7 illustrates a pair of signs in accordance with the invention mounted to a gasoline price board.

FIG. 7 illustrates an application of the present invention. A pair of changeable signs 20 as shown in FIG. 1 are shown mounted to a price board 80 at a gasoline filling station. The provision of two signs allows the prices of diesel and unleaded grades of gasoline, for example, to be simultaneously displayed. A number may be formed on the sign following the last digit of gasoline price to display fractional gasoline prices such as "$1.23^{9}$". The price board 80 is supported by a post 82. A control box 84 for changing the numerical display of the two signs 20 is provided at the base of the post.

Figure 8:
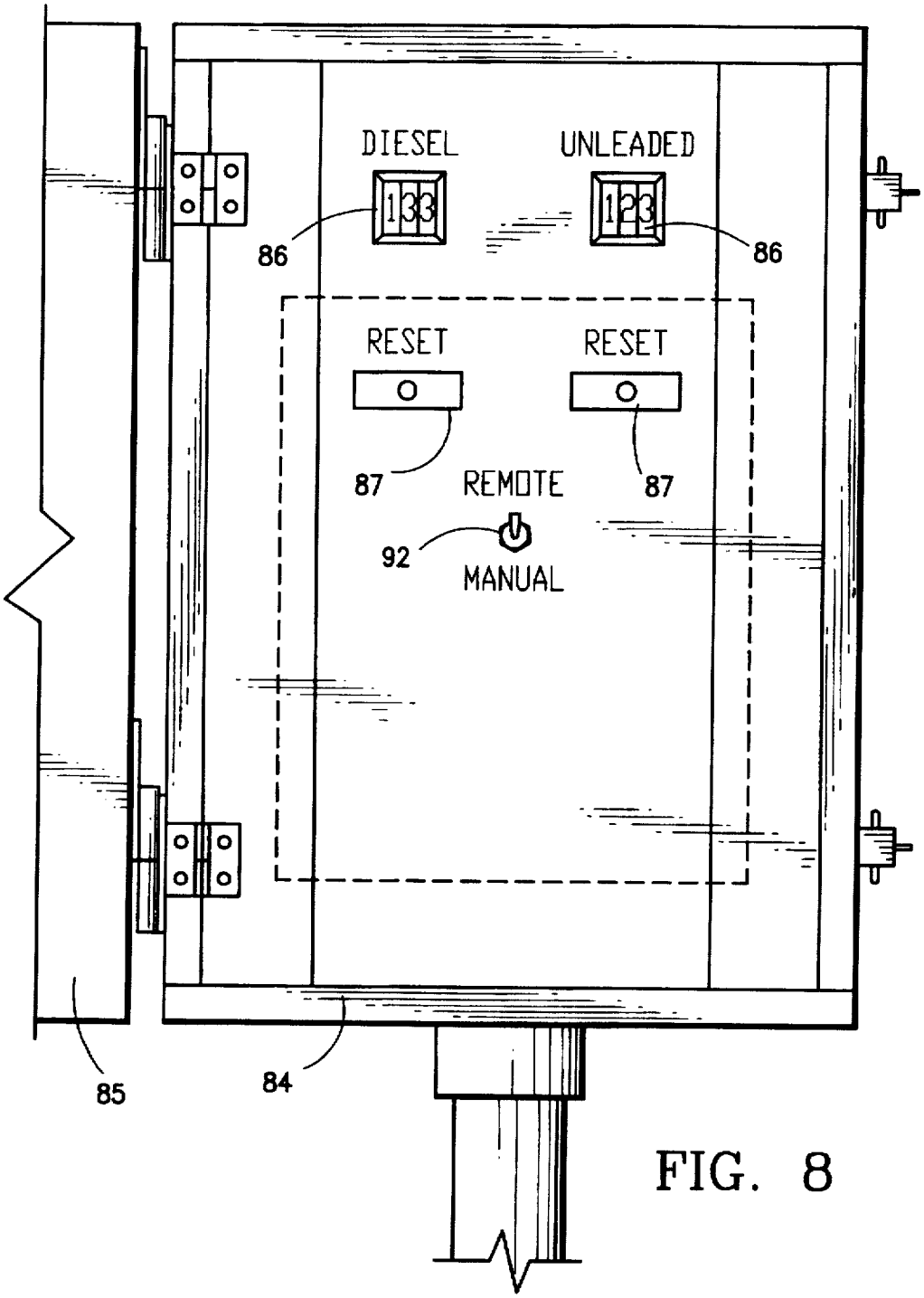
FIG. 8 is an enlarged view of a control box for controlling the operation of the signs of FIG. 10 in an opened position.

FIG. 8 is an enlarged view of the control box 84 with the hinged cover 85 opened, showing thumb wheel switches 86 for controlling the display of the signs 20 of FIG. 7. The settings of the switches 86 correspond to the digits of the numbers displayed in the associated signs. Number reset buttons 87 are also provided in the control box. In operation, the thumb wheel switches are set, and the reset buttons are then depressed until the associated signs display the desired numbers.

Figure 9:
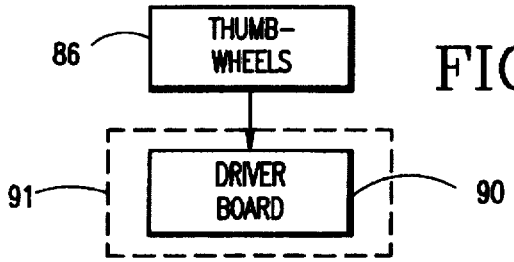
FIG. 9 is a block diagram of thumb wheels and driver board for manual on-site control of the changeable character display assemblies.

With reference to FIG. 9, each number display preferably has an associated electronic driver board 90 to control the motors of each display assembly or section. The control board comprises relays or like high-current electronic switches for energizing the motors in the forward and reverse directions to rotate the associated flaps clockwise and counter-clockwise. The control board also comprises electronic circuitry and software that decodes binary or other such digital input from various suitable controllers. The software energizes the proper relays to activate the motors to display the desired digit. The input may be performed on-site using the thumb wheel switches, or remotely using radio, pager (commonly known as a "beeper") or telephone remote controllers as described below. An infrared remote controller may be used if the operator is within sufficiently close range to the receiver.

When the reset buttons 87 are manually depressed, power is provided to the electronic control unit 91 in the control box. For the manual mode of operation, the electronic control unit comprises a driver board 90 (see FIG. 12) which directs power to the motors of the display assemblies.

When a remote controller is used to control the sign display, the reset buttons 87 are connected to a relay circuit (not shown) so that the remote controller board activates a driver board of the electronic control unit 91 associated with the remote controller. As shown in FIG. 8, a switch 92 is provided to allow the operator to select between the manual and remote modes of operation. If the remote controller malfunctions or is not available, the switch can be moved to the manual control mode to allow the motors to be controlled on-site using the thumb wheel switches provided in the control box 84.

Figure 10:
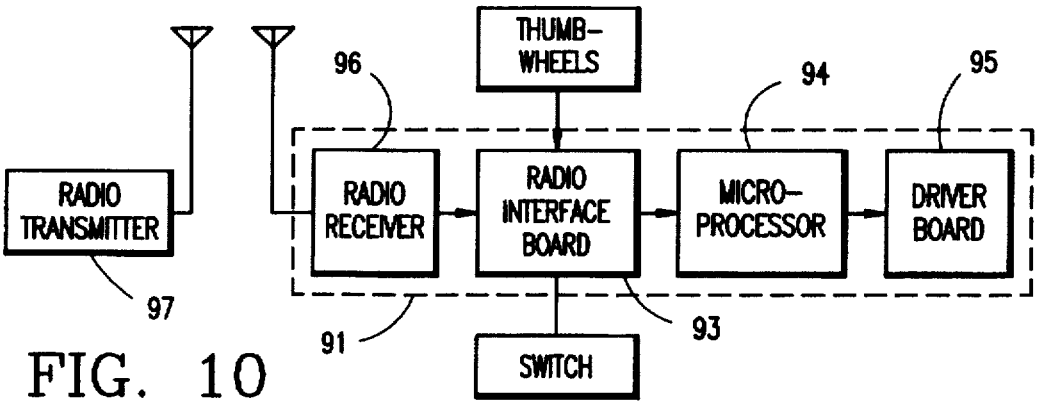
FIG. 10 is a block diagram of the electronic components of a radio remote controller for remotely controlling the changeable character display assemblies.

Referring to FIG. 10, the electronic control unit 91 of the radio remote controller includes a radio interface board 93, a microprocessor 94, at least one driver board 95 and a radio receiver 96. The radio receiver may be a CB, VHF or like transceiver. Tones received from the radio receiver are decoded by the radio interface board and converted to digital data which is read by the microprocessor. The microprocessor provides an output to the driver board, and activates the relay, which bypasses the reset switch(es) to provide power to the driver board for a sufficient amount of time to change the display. The operator uses a radio transmitter 97 to send signals to the radio receiver. A tone generating key pad (not shown) is attached to the radio transmitter. A sequence of numbers are entered on the key pad. The key pad generates the proper tones, and the tones are transmitted by the radio transmitter to the radio receiver.

Figure 11:
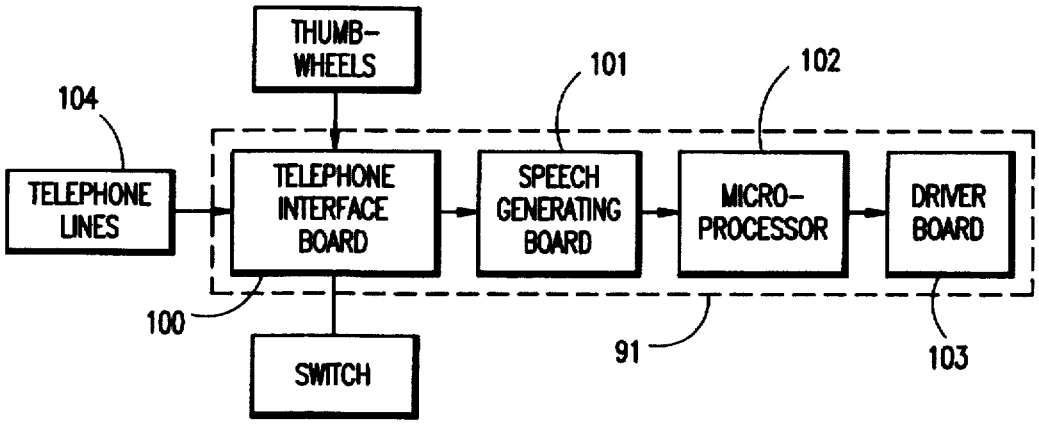
FIG. 11 is a block diagram of the electronic components of a telephone remote controller for remotely controlling the changeable character display assemblies.

Referring to FIG. 11, the electronic control unit 91 of the telephone remote controller board comprises an FCC-approved telephone interface board 100, a speech generating board 101, a microprocessor 102 and at least one driver board 103. Each sign location has a telephone line 104. After the telephone number of the location is dialed, the operator follows the voice prompts generated by the microprocessor and the speech generating board and then enters the digits to be displayed by the sign(s) on the telephone keypad. The microprocessor and telephone interface board control the driver board as in the other types of remote controllers.

Figure 12:
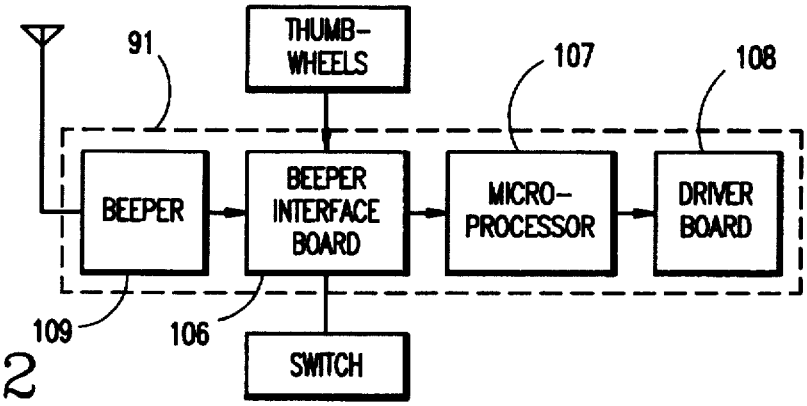
FIG. 12 is a block diagram of the electronic components of a beeper remote controller for remotely controlling the changeable character display assemblies.

Referring to FIG. 12, the electronic control unit 91 of the beeper remote controller board comprises a beeper interface board 106, a microprocessor 107 and at least one driver board 108. The beeper remote controller board operates in the same manner as the radio remote controller shown in FIG. 10 except that the beeper interface board replaces the radio interface board. The user calls the beeper 109 in the sign and enters the digits to be displayed instead of entering a telephone number. The beeper is activated through a local beeper service as in conventional beepers. The beeper interface board does not include tone decoding circuitry because the beeper decodes the tones that it receives and inputs them directly into the beeper interface board, which controls the driver board.

For each of the above-described controlling methods, power is supplied to the motors only for the time needed to change the number display. This feature reduces energy consumption and allows the signs to be powered by batteries, DC power supplies and other suitable power sources.

In accordance with the invention, the motors 60, 62 may optionally be controlled using a plurality of switches, with one switch being provided for each motor. For example, three-position rocker switches having off-center, on-off-on positions may be used (not shown). These switches normally are in the "off" position. Pressing the switch in opposite directions causes the motor to operate in respective reverse directions to rotate the flaps between the light and dark colored faces.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A changeable display sign comprising:

a housing defining an interior, a plurality of horizontally spaced columns each of which includes a plurality of vertically spaced changeable character display sections, each changeable character display section including a plurality of closely spaced and generally parallel flaps having first and second faces, each of said flaps being pivotally supported within said housing, drive means connected to one of said flaps of each of said changeable character display sections for rotating said one of said flaps to selectively orient one of said first and second faces thereof in a direction for display, means for pivotally connecting each of said flaps of a changeable character display section to one another so that each of said flaps of a changeable character display section is simultaneously rotated with said one of said flaps to selectively orient one of said first and second surfaces thereof in the direction for display and means for activating each of said drive means to control the orientation of each of said flaps of each of said changeable character display sections.

2. The changeable display sign of claim 1 in which said first and second faces are color contrasted so that said first faces are lighter than said second faces.

3. The changeable display sign of claim 2 in which said housing includes a back, a peripheral frame, and a cover defining a substantially enclosed interior, said cover being at least partially formed of a transparent material.

4. The changeable display sign of claim 1 wherein said means for pivotally connecting said flaps of each of said changeable character display sections includes a bracket and means for pivotally connecting each of said flaps to said bracket.

5. The changeable display sign of claim 4 wherein each of said drive means includes a motor mounted within said interior of said housing and a drive rod connecting each of said motors to said one of said flaps of each changeable character display section.

6. The changeable display sign of claim 5 in which at least one of said drive rods is drivingly connected to rotate said one of said flaps of said changeable character display sections of at least two of said columns.

7. The changeable display sign of claim 6 in which each of said flaps includes a pair of spaced side walls having aligned openings therein, means for pivotally supporting said flaps within said interior of said housing extending through said aligned openings, and each drive rod having a non-circular cross-section of a predetermined configuration extending through aligned non-circular openings in said one of said flaps, said non-circular openings having a configuration to be drivingly engaged with said predetermined configuration of said drive rods.

8. The changeable display sign of claim 5, further comprising means for remotely controlling each of said motors.

9. The changeable display sign of claim 8, wherein said means for remotely controlling is selected from the group of control means consisting of radio remote controllers, telephone remote controllers and pager remote controllers.

10. The changeable display sign of claim 1 including at least one fixed display section in at least one of said columns of said changeable character display sections.

11. A changeable display sign comprising:

a housing having a front cover and a back and an interior, at least one first changeable display assembly mounted within said interior for displaying changeable characters, said at least one display assembly including a plurality of first vertically spaced changeable sections, each of said first changeable sections including a plurality of first flaps, each of said first flaps having first and second faces, and means for connecting each of said first flaps in a first changeable section so that said first flaps are simultaneously rotatable to selectively orient one of said first and second faces adjacent said front cover of said housing, means for pivotally supporting each of said first flaps within said interior of said housing so as to be generally parallel with one another, means drivingly connected to at least one of said first flaps of each of said first changeable sections to pivot said at least one flap to selectively orient one of said first and second faces thereof toward said front covers whereby upon pivoting of said at least one first flap, each of said first flaps connected thereto will pivot with one another to simultaneously orient said first and second faces of said first flaps relative to said front cover.

12. The changeable display sign of claim 11 including at least one second changeable character display assembly mounted within said interior of said housing in horizontally spaced relationship to said first changeable character display assembly, said at least one second display assembly including a plurality of second columns each including a plurality of second vertically spaced second changeable sections, said second changeable sections each including and a plurality of second flaps having first and second faces, and means for pivotally connecting each of said second flaps in a second changeable section so that said second flaps are simultaneously rotatable to selectively orient one of said first and second faces thereof adjacent said front cover of said housing, means for pivotally supporting each of said second flaps of said second changeable sections within said interior of said housing so as to be generally parallel with one another, and means drivingly connected to at least one of said second flaps of each of said second changeable sections to pivot said at least one second flap to selectively orient either said first or second face thereof relative to said front cover of said housing, whereby upon pivoting of said at least one second flap, each of said second flaps connected thereto will pivot with one another to simultaneously orient said first and second faces of said second flaps relative to said front cover.

13. The changeable display sign of claim 12 including a plurality of first changeable character display assemblies and a plurality of second changeable character display assemblies.

14. The changeable display sign of claim 12 in which said means for pivotally supporting said first flaps and said means for pivotally supporting said second flaps include a plurality of vertically spaced support rods, at least one of said first flaps and one of said second flaps being supported on a common support rod.

15. The changeable display sign of claim 12 including a plurality of second changeable character display assemblies mounted within said interior of said housing in horizontal relationship with respect to one another.

16. The changeable display sign of claim 15 in which said housing includes a peripheral frame and said front cover being at least partially formed of a transparent material.

17. The changeable display sign of claim 16 including at least one non-changeable section in at least one of said columns of each of said second changeable character display assemblies.

18. The changeable display sign of claim 17 in which each of said first faces of each of said first and second flaps is highly contrasted with respect to said second faces thereof.

19. The changeable display sign of claim 18 wherein each of said means drivingly connected includes a motor mounted within said interior of said housing and means operably connected to control said motors.

20. The changeable display sign of claim 19 in which each of said motors is drivingly connected to rotate one of said means for pivotably supporting.

21. The changeable display sign of claim 20 in which each of said first and second flaps includes a pair of spaced side walls having aligned openings therein, and said support means for pivotably supporting said first and second flaps within said interior of said housing extending through said aligned openings.

22. The changeable display sign of claim 19 in which said control means includes means for remotely controlling each of said motors.

23. The changeable display sign of claim 22, wherein the means for remotely controlling is selected from the group of control means consisting of radio remote controllers, telephone remote controllers and pager remote controllers.

* * * * *